US006099656A

United States Patent [19]

Kustermann et al.

[11] Patent Number: 6,099,656

[45] Date of Patent: Aug. 8, 2000

[54] APPARATUS AND PROCESS FOR THE PREVENTION AND REMOVAL OF OBSTRUCTIONS IN THE OUTLET OPENING OF A METERING SLOT OF A COATING APPARATUS

[75] Inventors: Martin Kustermann, Heidenheim; Patric Romes, Sontheim, both of Germany

[73] Assignee: Voith Sulzer Papiertechnik Patent GmbH, Heidenheim, Germany

[21] Appl. No.: 09/283,108

[22] Filed: Mar. 31, 1999

[30] Foreign Application Priority Data

Apr. 1, 1998 [DE] Germany ..... 198 14 490

[51] Int. Cl.[7] ..... B08B 9/00; B05B 13/00

[52] U.S. Cl. ..... 134/8; 427/356; 118/413

[58] Field of Search ..... 134/8, 6; 118/413, 118/410, 419, 712; 427/356

[56] References Cited

U.S. PATENT DOCUMENTS

| | | | |
|---|---|---|---|
| 5,436,030 | 7/1995 | Damrau | 427/240 |
| 5,558,716 | 9/1996 | Mitani et al. | 118/410 |
| 5,795,394 | 8/1998 | Belosterkovsky et al. | 118/419 |
| 5,858,096 | 1/1999 | Madrzak et al. | 118/410 |
| 5,873,940 | 2/1999 | Takahashi et al. | 118/410 |
| 5,940,925 | 8/1999 | Gohler et al. | 118/413 |
| 6,027,768 | 2/2000 | Koskinen et al. | 118/410 |

FOREIGN PATENT DOCUMENTS

| | | | |
|---|---|---|---|
| 0 466 420 B1 | 10/1985 | European Pat. Off. | B05C 5/02 |

*Primary Examiner*—Saeed T. Chaudhry
*Attorney, Agent, or Firm*—Taylor & Aust, P.C.

[57] ABSTRACT

An apparatus and process prevents and removes obstructions in the discharge opening of a metering slot of a coating apparatus, or fountain applicator, applying a coating medium onto a moving material web. The process repeatedly removes obstructions from the discharge opening of the metering slot, thereby preventing defects in the applied coating. The apparatus includes a scraper disposed and translatory movable within the discharge opening in a direction transverse to the direction of movement of the material web.

19 Claims, 2 Drawing Sheets

APPARATUS AND PROCESS FOR THE PREVENTION AND REMOVAL OF OBSTRUCTIONS IN THE OUTLET OPENING OF A METERING SLOT OF A COATING APPARATUS

BACKGROUND OF THE INVENTION

1. Field of the Invention

The present invention relates to a process for preventing and removing obstructions in the outlet opening of a metering slot of a coating apparatus.

2. Description of the Related Art

Coating apparatuses serve the function of applying a liquid or viscid coating medium onto a moving material web such as paper or carton. Coating apparatuses are well-known, and the following references serve to provide additional documentation: U.S. Pat. Nos. 5,436,030 and 5,858,096, EP patent document nos. 0,466,420 and 0,701,022, and German patent document nos. 9,417,321 and 9,417,324. These publications describe free jet coating apparatuses, also known as fountain applicators or JetFlow F, having a metering slot between two protruding surfaces, hereinafter referred to as lips. The coating medium is supplied to the metering slot by a distribution pipe residing within a girder which extends across the width of the coating apparatus. The coating medium travels from the distribution pipe through passages to the metering slot from which the coating medium exits in the form of a free jet.

In the case of direct application, the material web runs by the metering slot and the coating medium is directly applied onto the web. In these cases, the material web is typically guided by the outer surface of a support roll. In the case of indirect application, the coating medium is first applied onto the surface of an applicator roll and is subsequently transferred onto the material web in the nip area through which the web traverses.

The lip which resides on the side of the metering slot facing the oncoming web is referred to as "inboard" lip. Accordingly, the lip which resides on the outboard side of the metering slot is referred to as the "outboard" lip.

Inside the exit opening of the metering slot, or the jet exit opening, there is a tendency for dirt particles, lumps or other undesirable solid matter particles to collect, causing the coating medium that is exiting the metering slot to "break up", resulting in an insufficient coating on the material web or, worse yet, allowing the contamination onto the web itself. This condition results in defects in the coating that has been applied to the material web. Trained machine operators are relied upon to recognize and detect these defects. The cause of these defects (i.e., undesirable particles within or expelled from the metering slot) must be subsequently removed from the metering slot by means of a scraper, such as a piece of plastic strip. This process, however, is very time-consuming and can only be performed when the coating apparatus is not operating. Furthermore, this task requires skill and experience on the part of the machine operator.

These defects, however, can also be detected by means of a specially-designed sensing device which then generates the appropriate alert signals. In order to respond to the signals with appropriate counter measures, upon recognition of a defect on the coating at least one operating parameter of the coating apparatus must be adjusted or modified in an attempt to dislodge the obstructions from the metering slot while the material web continues to run. Specifically, this process and the corresponding devices require the manipulation, either temporarily or repeatedly, of operating parameters, such as the coating medium pressure or the width of the metering slot, which affect the characteristic features of the jet of coating medium exiting the metering slot or the shape of the jet pattern. A disadvantage of this approach is that the coating apparatus must always be re-adjusted (at least approximately) to the initial parameter settings, which requires additional resources.

SUMMARY OF THE INVENTION

The present invention removes obstructions accumulated within the metering slot of a coating apparatus. The removal of the obstructions (i.e., undesirable particles in the metering slot) is accomplished, in one embodiment, by scraping actions which push the undesirable particles to the side of the machine where they no longer cause any harm. The scraping of the particles from within the metering slot occurs temporarily or repeatedly, if appropriate, along substantially the entire length of the metering slot in the transverse direction of the coating apparatus.

A second embodiment removes the undesired particles through crushing or squelching of the particles. The surface of the crushing device is made to a rough surface finish specification or is shaped in such a way (e.g., convex) as to promote the crushing action. The crushing device is configured to oscillate back and forth in order to improve the crushing efficiency. The crushed or squelched particles are now of a size which no longer causes any disturbances in the discharge of coating medium or defects on the coating. The smaller, crushed particles exit the metering slot trouble-free, aided by the pressure of the exiting coating medium.

The scraping or crushing device is activated in the transverse direction by use of an attached or integrated activation device. This activation device can include a cable winch, a V-guide (prismatic guide), or other similar mechanism. When one or more defects are recognized on the material web by a trained machine operator or an optical sensing device, the activation device is operated or a drive mechanism, attached to the activation device, is turned on, thus initiating the cleaning process by moving the scraping or crushing device in a substantially straight translatory motion along the metering slot, thereby removing through scraping or crushing any undesirable particles accumulated within the metering slot or the exit opening therein.

Once the presence of defects are recognized by the optical sensing device, it is possible to announce the need for cleaning in a visual or audible manner, thereby alerting the machine operators to respond by operating the activation device or turning on the drive mechanism and thus initiating the movement of the scraping or crushing device. The optical sensing device can be linked to a control unit which, in turn, is connected to the drive mechanism in a manner that allows an automatic activation of the scraping or crushing device upon recognition of a defect. As a result of this mechanized or automated method—which has proven to yield substantial improvements in terms of operational efficiency—a temporary activation of this scraping or crushing device is feasible, even during normal operation of the unit.

The fountain applicators typically operate on the basis of excess application which means that more of the medium is applied on the material web than is theoretically required. Due to the mobility of the scraper, the defects appear only briefly, and are usually smoothed sufficiently by a blade coater or doctor unit typically positioned downstream of the coating apparatus (i.e. after the coating apparatus relative to the direction of movement of the material web).

Devices to scrape or push obstructions or dried-on pigment particles from the relevant surfaces generally include tools which substantially correspond to the cross-sectional area and shape of the discharge element of the metering slot. However, this scraping device can be, for example, a bent wire or a strip of plastic which is pulled by a cable pull through the metering slot in the transverse direction relative to the movement of the material web. The undesirable particles, which have been collected by the scraper during the cleaning process, are deposited at the format sliders which keep the edges of the material web from being coated. Once there, the particles do not disrupt the coating process.

It is to be understood that the cleaning process can also be performed either before, during or after a coating operation. In using this method, the resulting defects of the coating are substantially improved when compared to defects that are the direct result of local (permanent) clogging.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
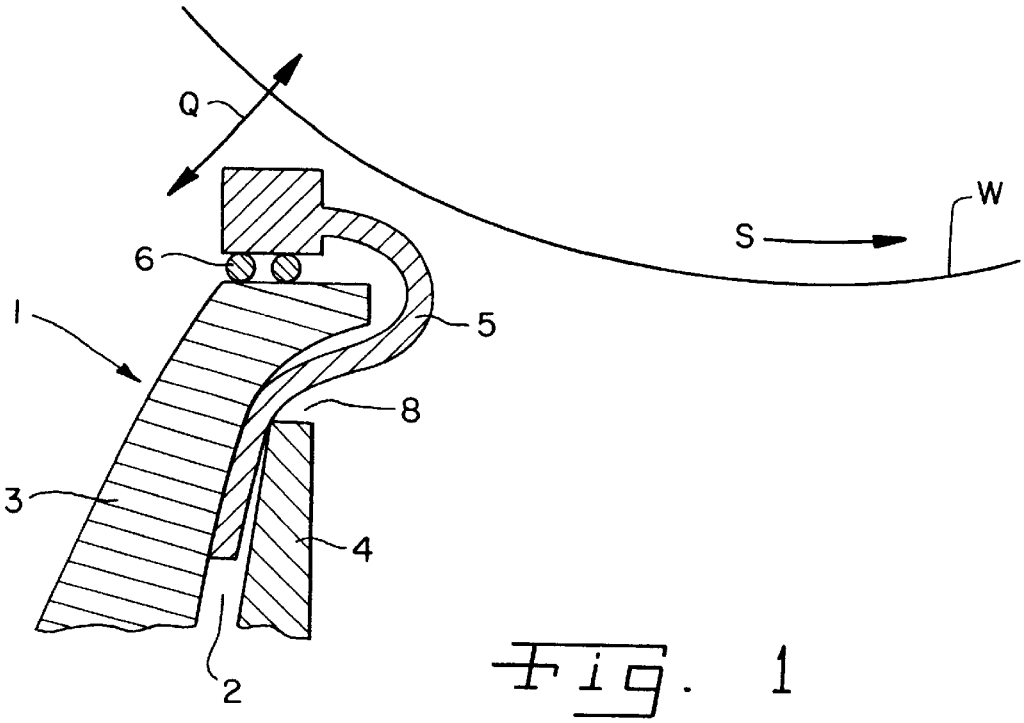
FIG. 1 is a schematic, cross-sectional view of the metering slot exit opening of a fountain applicator of the present invention.

FIG. 1 shows the upper area of fountain applicator 1 including exit opening 8 of metering slot 2, which extends across the entire width of fountain applicator 1. Metering slot 2 is formed by lip 3 and lip 4, each of which extend across the entire width of fountain applicator 1. Adjacent to fountain applicator 1 is a running substrate, shown as material web W, or alternatively a tape or an applicator roll, moving in direction S. Scraper 5 is positioned at inboard lip 3 and protrudes over activation mechanism 12 which, in the embodiment shown, is configured as cables 6 of a cable pull (not shown). Activation mechanism 12 is connected to drive mechanism 14 (see FIG. 2), such as an electric drive (not shown).

Scraper 5 is a formed part whose cross-sectional area is substantially equivalent to that of exit opening 8 of metering slot 2 in order to efficiently and reliably remove undesirable particles from either side of exit opening 8 of metering slot 2. Scraper 5 moves in translatory direction Q across substantially the entire width of exit opening 8 of metering slot 2 of fountain applicator 1. Scraper 5 can be alternatively configured as a bent, solid metal wire. Also suitable is a flexible strip of plastic since it won't damage the side walls or guiding surfaces of the metering nozzle while traversing metering slot 2.

Figure 2:
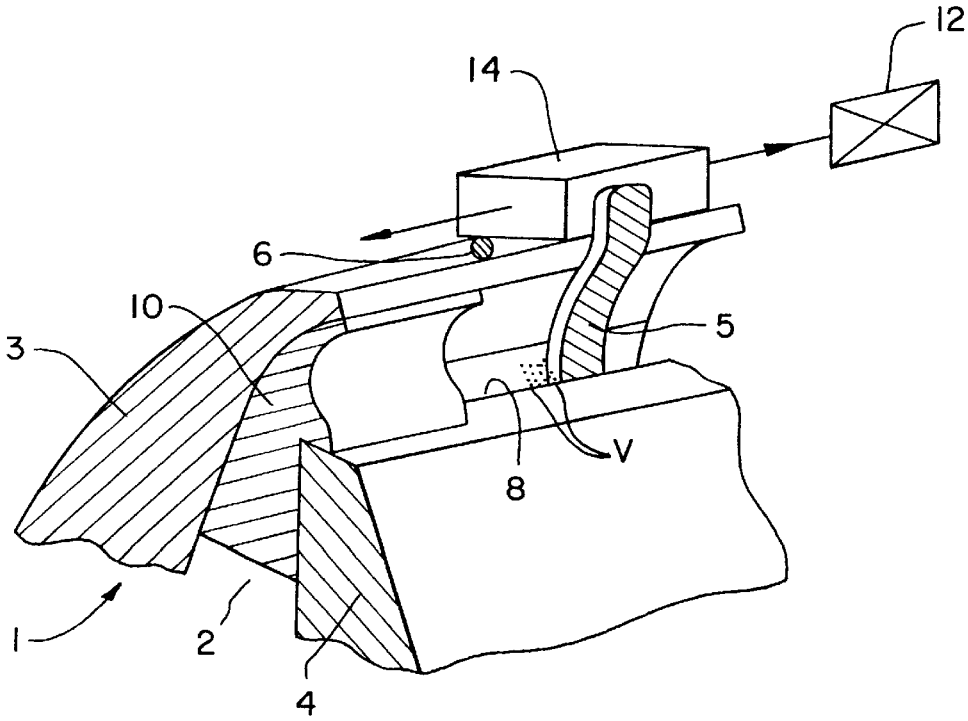
FIG. 2 is a three-dimensional representation of the fountain applicator of FIG. 1.

FIG. 2 shows scraper 5; for clarity reasons, FIG. 2 depicts only one side of the coating apparatus including format slider 10. The other side of the coating apparatus is designed identically. FIG. 2 schematically shows activation device 14 which, acted upon by drive mechanism 12, moves scraper 5 through metering slot 2 thereby pushing the obstructions V from metering slot 2 and discharge opening 8 off to format slider 10. Activation device 14 is, in this embodiment, configured as a cable pull. If there is no cleaning process ongoing, then activation device 14 is at idle, with scraper 5 positioned at format slider 10. This idle position of scraper 5 prevents any adverse effects during normal coating operation.

Figure 3:
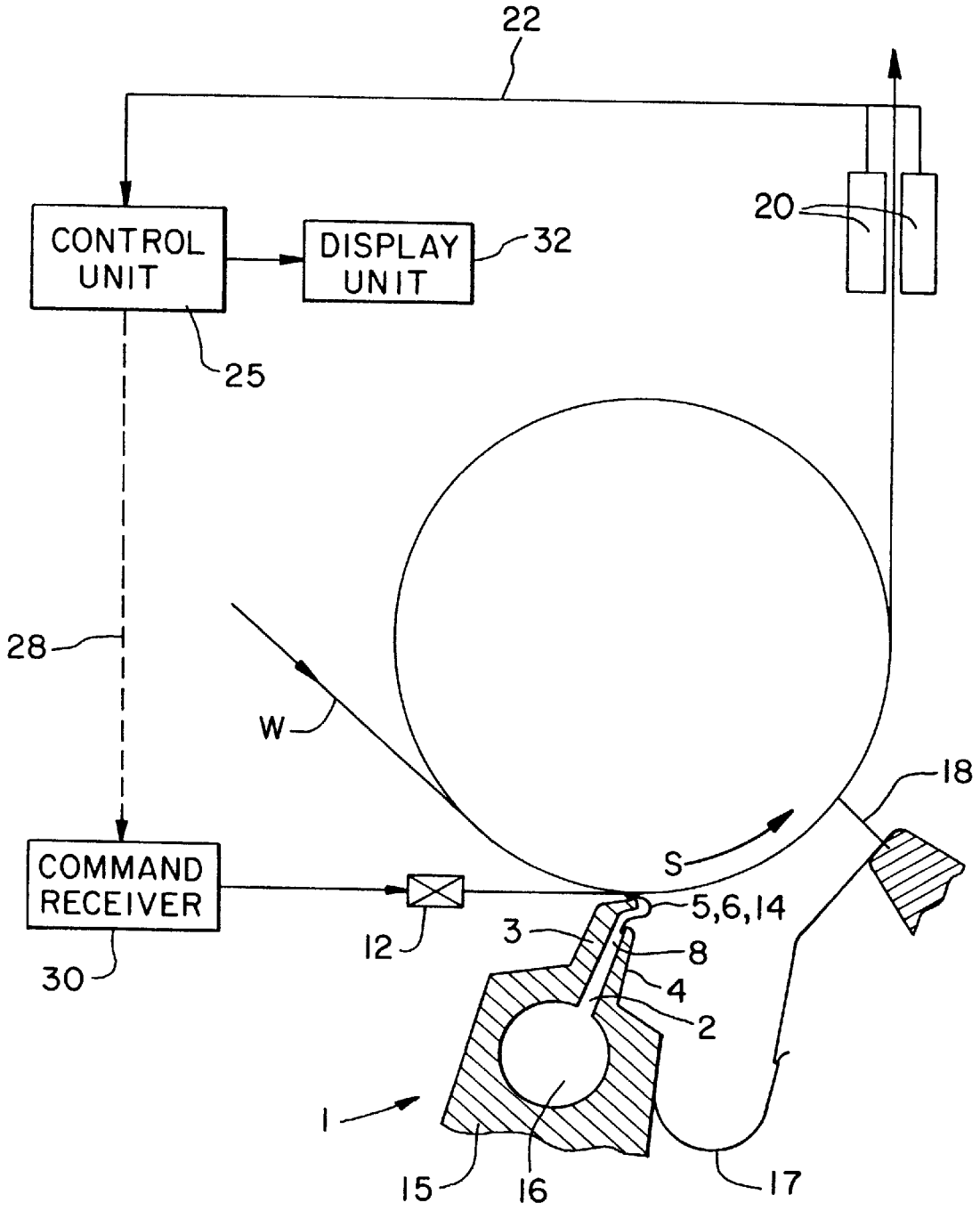
FIG. 3 depicts a fountain applicator with a control mechanism designed for a process of the present invention.

FIG. 3 illustrates fountain applicator 1 for direct application of a coating medium onto material web W. Fountain apparatus 1 includes girder 15 containing a coating medium distribution pipe 16 connected to metering slot 2, which includes lip 3, lip 4, and exit opening 8. Coating apparatus 1 further includes overflow duct 17. A blade coater 18 for final metering of the previously applied coating is located a predetermined distance from coating apparatus 1 in direction S. Blade coater 18 is thus positioned downstream from coating apparatus 1 (i.e. blade coater 18 is positioned after coating apparatus 1 relative to the direction of movement of substrate W). Scraper 5 and associated activation device 14, which is attached to drive mechanism 12, are shown in thick lines.

Dirt particles or other solid particles such as pigment particles typically conglomerate and either attach themselves to the exit opening 8 of metering slot 2, or exit metering slot 2 in full size and are subsequently deposited on material web W together with the coating medium, inevitably leading to defects in the applied coating. As long as the problem persists, the defect is reflected in the form of a streak or a dotted line. Occasionally, when the problem reaches a certain magnitude, the defects become visible to the unaided eye.

In order to capture defects reliably, sensing assembly 20 is configured to examine material web W for defects or blemishes. In the present embodiment, sensing assembly 20 is configured to detect defects or blemishes through an opacity measurement. The sensing signals of sensing assembly 20 are transmitted via connections 22 to control unit 25 which is equipped with an integrated interpretation logic. If the presence of a defect in the coating medium is detected on material web W, control unit 25 transmits a control signal via connections 28 (shown in dashed lines) to command receiver 30. Command receiver 30 initiates drive mechanism 12 of activation device 14 and, thereby, activates the movement of scraper 5.

Control unit 25 can be alternatively configured to, upon detecting the presence of defects, emit an audible or optical signal through an indicator unit such as display unit 32. The machine operators can then quickly respond to the signal by operating activation device 14 or through activating drive mechanism 12.

In the embodiment shown, scraper 5 is positioned at inboard lip 3 and protrudes over cables 6 of a cable pull (not shown), which is connected to drive mechanism 12. It is to be understood that alternative sites can be used to provide room for the cable pull. Scraper 5 is, in the embodiment shown, a formed part whose cross-sectional area is substantially equivalent to the exit opening 8 of metering slot 2 in order to efficiently and reliably remove undesirably particles from either side of metering slot 2. It is to be understood, however, that scraper 5 could be alternatively configured to achieve the same purpose. For example, scraper 5 could be configured as two scraping elements, each being configured to scrape a respective one of lip 3 and lip 4 of metering slot 2.

In the embodiment shown, command receiver 30 and drive mechanism 12 are shown as two separate entities. However, it is to be understood that the functions of command receiver 30 and drive mechanism 12 can be integrated into one unit that is configured to both receive the control signal from control unit 25 and drive activation device 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for removing obstructions and other undesirable particles from a coating medium discharge opening of a coating apparatus, the coating apparatus applying a coating medium onto a moving fiber material web having a direction of travel, said method comprising the steps of:

placing at least one scraping element at least partially within the coating medium discharge opening of the coating apparatus; and moving at least one said scraping element along at least a portion of the coating medium discharge opening in a direction transverse to the direction of travel of the material web in at least one of a temporary and repeated manner using at least one corresponding activation device.

2. The method of claim 1, wherein said at least one scraping element has a cross-sectional area that is substantially equal to a cross-sectional area of the coating medium discharge opening of the coating apparatus.

3. The method of claim 1, comprising the further steps of:

scraping off the obstructions; and depositing the obstructions at an edge of the coating apparatus.

4. The method of claim 1, wherein said moving step includes crushing the obstructions.

5. The method of claim 4, wherein said moving step further includes oscillating said at least one scraping element.

6. The method of claim 1, comprising the further steps of:

sensing the presence of defects in the coating medium applied to the material web with a sensing assembly;

providing at least one sensing signal indicative of the presence of defects in the coating medium applied to the material web with said sensing assembly;

associating a drive unit with said activation device, said drive unit being configured for operating said activation device;

electrically connecting a control unit to said drive unit, said control unit receiving said sensing signal and providing at least one control signal dependent thereon; and automatically initiating the operation of said drive unit dependent upon said at least one control signal.

7. The method of claim 6, wherein said sensing assembly includes at least one optical sensor.

8. The method of claim 1, comprising the further steps of:

sensing the presence of defects in the coating medium applied to the material web with a sensing assembly;

providing at least one sensing signal indicative of the presence of defects in the coating medium applied to the material web;

associating a drive unit with said activation device, said drive unit being configured for operating said activation device;

issuing a warning signal dependent upon said at least one sensing signal; and manually initiating operation of said drive unit in response to said warning signal.

9. The method of claim 8, wherein said sensing assembly includes at least one optical sensor.

10. The method of claim 8, wherein said issuing step includes transmitting at least one of an audible and a visual signal.

11. The method of claim 1, wherein said moving step occurs while the coating apparatus is in operation and while the material web is moving.

12. The method of claim 1, wherein said moving step occurs while the coating apparatus is not in operation and while the material web is not moving.

13. A coating apparatus for applying a coating medium onto a moving material web having a direction of travel, said coating apparatus comprising:

a pair of opposing lips with a coating medium discharge opening therebetween, said discharge opening having a length extending transverse to the direction of travel of the material web;

at least one scraping element disposed at least partially within said coating medium discharge opening of the coating apparatus; and an activation device associated with and configured for moving said at least one scraping element along at least a portion of said length of said coating medium discharge opening in a direction transverse to the direction of travel of the material web.

14. The coating apparatus of claim 13, wherein said coating medium discharge opening has a cross-sectional area, and wherein said at least one scraping element has a cross-sectional area that is substantially equal to said cross-sectional area of said coating medium discharge opening, said at least one scraping element being in contact with at least one of said opposing lips at least during movement of said scraping element by said activation device.

15. The coating apparatus of claim 13, wherein said at least one scraping element has a crushing surface, said crushing surface being at least one of convex in shape and of a rough surface finish, said scraping element being configured for crushing obstructions in said coating medium discharge opening.

16. The coating apparatus of claim 13, further comprising:

a sensing assembly sensing the presence of defects in the coating medium applied to the material web and providing at least one sensing signal indicative thereof;

a control unit electrically connected to said at least one sensing assembly, said control unit receiving said at least one sensing signal and providing at least one control signal dependent upon said at least one sensing signal; and a drive unit associated with said activation device and electrically connected to said control unit, said drive unit receiving said at least one control signal and being configured for operating said activation device, said drive unit configured to be automatically activated dependent upon said at least one control signal.

17. The method of claim 13, wherein said sensing assembly includes at least one optical sensor.

18. The coating apparatus of claim 13, further comprising:

a sensing assembly sensing the presence of defects in the coating medium applied to the material web and providing at least one sensing signal indicative thereof;

a control unit electrically connected to said at least one sensing assembly, said control unit receiving said at least one sensing signal; and at least one indicator unit electrically connected to said control unit, said control unit emitting through said indicator unit at least one of a visible and an audible signal dependent thereon; and a drive unit associated with said activation device, said drive unit being configured for operating said activation device and for being manually activated.

19. The method of claim 18, wherein said sensing assembly includes at least one optical sensor.

* * * * *